US012059114B2

(12) United States Patent
Rowe et al.

(10) Patent No.: US 12,059,114 B2
(45) Date of Patent: Aug. 13, 2024

(54) DISHWASHING APPLIANCE AND REMOVABLE RACK ACCESSORY

(71) Applicant: Haier US Appliance Solutions, Inc., Wilmington, DE (US)

(72) Inventors: Jason Allen Rowe, Louisville, KY (US); Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/982,710

(22) Filed: Nov. 8, 2022

(65) Prior Publication Data

US 2024/0148228 A1 May 9, 2024

(51) Int. Cl.
*A47L 15/50* (2006.01)

(52) U.S. Cl.
CPC ..... *A47L 15/505* (2013.01); *A47L 15/503* (2013.01); *A47L 15/502* (2013.01)

(58) Field of Classification Search
CPC .... A47L 15/503; A47L 15/505; A47L 15/502; A47L 15/50; A47L 19/04; A47B 81/04
See application file for complete search history.

(56) References Cited

U.S. PATENT DOCUMENTS

| | | | | |
|---|---|---|---|---|
| 7,665,475 | B2 | 2/2010 | Hedstrom et al. | |
| 7,766,175 | B2 | 8/2010 | Jadhav et al. | |
| 8,701,898 | B2 | 4/2014 | Chai | |
| 11,006,814 | B1 * | 5/2021 | Simmonds | A47L 15/505 |
| 2006/0113260 | A1 * | 6/2006 | Purushothaman | A47L 15/505 211/41.9 |
| 2007/0247039 | A1 * | 10/2007 | Anderson | A47L 15/0084 211/41.9 |
| 2008/0210648 | A1 * | 9/2008 | Davis | A47L 19/04 211/41.3 |
| 2014/0285077 | A1 * | 9/2014 | Yoon | A47L 15/503 312/228.1 |
| 2023/0292987 | A1 * | 9/2023 | Kremmel | A47L 15/505 211/41.9 |

FOREIGN PATENT DOCUMENTS

| | | | | |
|---|---|---|---|---|
| CN | 108309197 A | * | 7/2018 | A47L 15/501 |
| CN | 109662676 A | * | 4/2019 | A47L 15/502 |
| CN | 110251037 A | * | 9/2019 | A41L 15/50 |
| CN | 216020892 U | * | 3/2022 | |
| DE | 102014201027 A1 | * | 7/2015 | A47L 15/503 |
| DE | 102017205726 A1 | * | 10/2018 | A47L 15/50 |

(Continued)

*Primary Examiner* — Kimberley S Wright
(74) *Attorney, Agent, or Firm* — Dority & Manning, P.A.

(57) ABSTRACT

A dishwashing appliance or removable rack accessory may include a rigid upper strut, a rigid lower strut, and a plurality of intermediate struts. The rigid lower strut may be spaced apart from the rigid upper strut along a vertical direction. The plurality of intermediate struts may extend between the rigid upper and lower struts. The intermediate struts may be generally movable along a transverse direction relative to the rigid upper and lower struts. The plurality of intermediate struts and the rigid upper and lower struts may collectively define a plurality of variable apertures extending through the removable rack accessory along a lateral direction to receive one or more container lids therein.

11 Claims, 12 Drawing Sheets

(56) References Cited

FOREIGN PATENT DOCUMENTS

| | | | | | |
|---|---|---|---|---|---|
| DE | 102020122046 | B3 | * | 2/2022 | |
| EP | 2322073 | A1 | * | 5/2011 | ..... A47L 15/503 |
| EP | 2394563 | B1 | | 5/2013 | |
| EP | 3357398 | B1 | | 3/2020 | |
| JP | 2006247152 | A | * | 9/2006 | |
| WO | WO2016192797 | A1 | | 12/2016 | |

* cited by examiner

DISHWASHING APPLIANCE AND REMOVABLE RACK ACCESSORY

FIELD OF THE INVENTION

The present subject matter relates generally to dishwashing appliances, and more particularly to removable accessories for dishwashing appliances.

BACKGROUND OF THE INVENTION

A dishwasher or dishwashing appliance generally includes a tub that defines a wash chamber for receipt of articles for washing. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance.

Some items are notoriously difficult to wash in most dishwashers. For example, lids to travel mugs, child drinking containers, and the like are not easily accepted within or on traditional rack assemblies. Because many rack assemblies are wire framed, large gaps are formed through which certain small objects may easily fall. These objects can then clog the drain system of the dishwasher. Further, certain smaller objects may collect water throughout a dishwashing operation when placed on a traditional rack assembly in a flat manner. This may lead to water stains or other undesirable after effects of a washing operation. Moreover, given the varying sizes and shapes of small objects (e.g., lids), it can be difficult to provide a region within a dishwasher in which such objects can be reliably received (e.g., in a desired orientation or without a high risk of falling out).

Accordingly, a dishwashing appliance or rack accessory that obviates one or more of the above-mentioned drawbacks would be beneficial. In particular, an adjustable rack accessory that holds smaller objects within a dishwashing appliance (e.g., while preventing the collection of standing water thereon) would be useful. It may be especially advantageous if such accessories could reliably accommodate relatively small objects of varying sizes or shapes.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a removable rack accessory for a dishwashing appliance is provided. The removable rack accessory may include a rigid upper strut, a rigid lower strut, and a plurality of intermediate struts. The rigid lower strut may be spaced apart from the rigid upper strut along a vertical direction. The plurality of intermediate struts may extend between the rigid upper and lower struts. The intermediate struts may be generally movable along a transverse direction relative to the rigid upper and lower struts. The plurality of intermediate struts and the rigid upper and lower struts may collectively define a plurality of variable apertures extending through the removable rack accessory along a lateral direction to receive one or more container lids therein.

In another exemplary aspect of the present disclosure, a dishwashing appliance is provided. The dishwashing appliance may include a tub, a rack assembly, and a removable rack accessory. The tub may define a wash chamber. The rack assembly may be slidably disposed within the wash chamber. The removable rack accessory may be rotatably attached to the rack assembly. The removable rack accessory may include a rigid upper strut, a rigid lower strut, and a plurality of intermediate struts. The rigid lower strut may be spaced apart from the rigid upper strut along a vertical direction. The plurality of intermediate struts may extend between the rigid upper and lower struts. The intermediate struts may be generally movable along a transverse direction relative to the rigid upper and lower struts. The plurality of intermediate struts and the rigid upper and lower struts may collectively define a plurality of variable apertures extending through the removable rack accessory along a lateral direction to receive one or more container lids therein.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended FIGURES.

Figure 1:
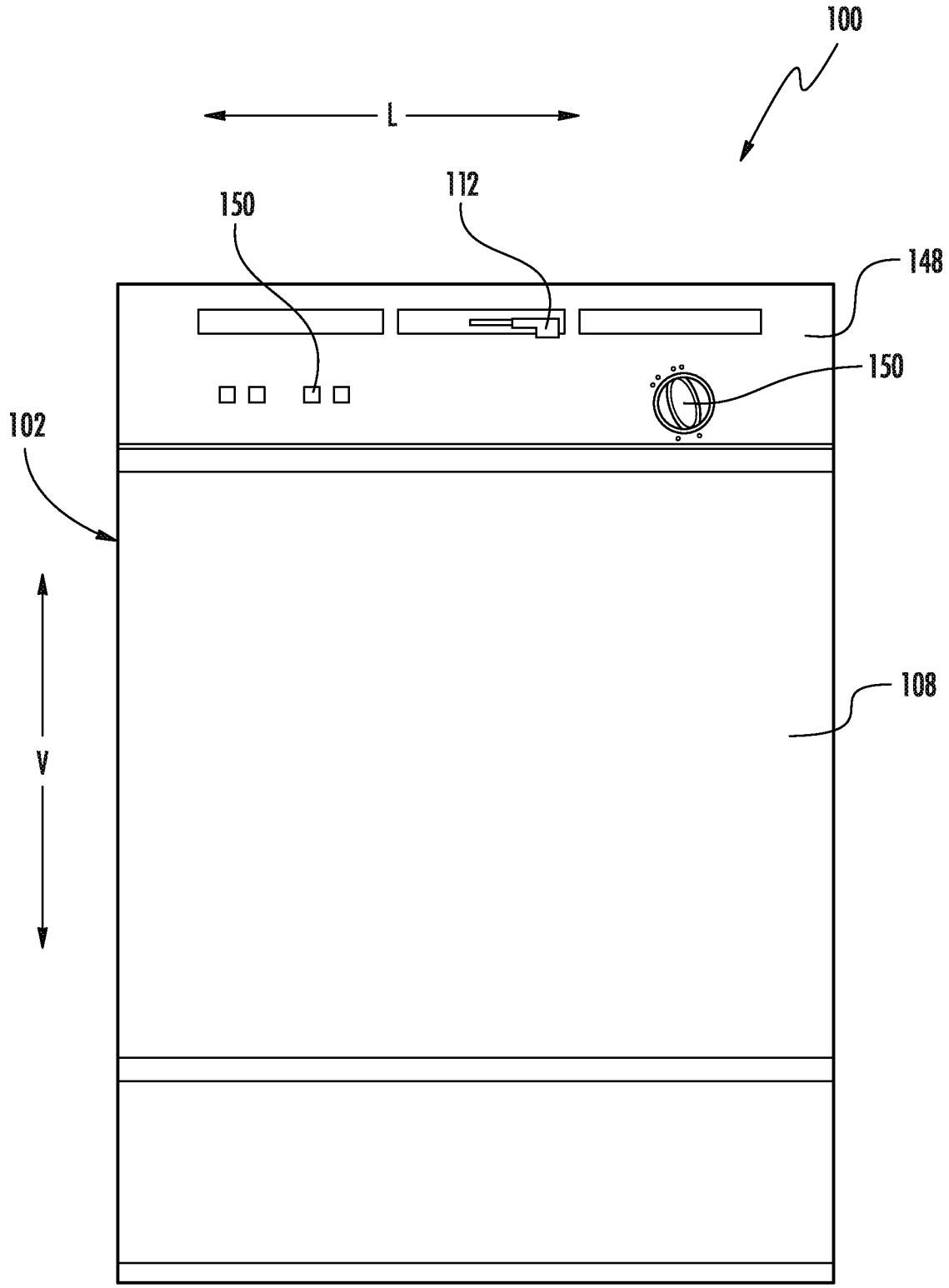
FIG. 1 provides a front elevation view of a dishwashing appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
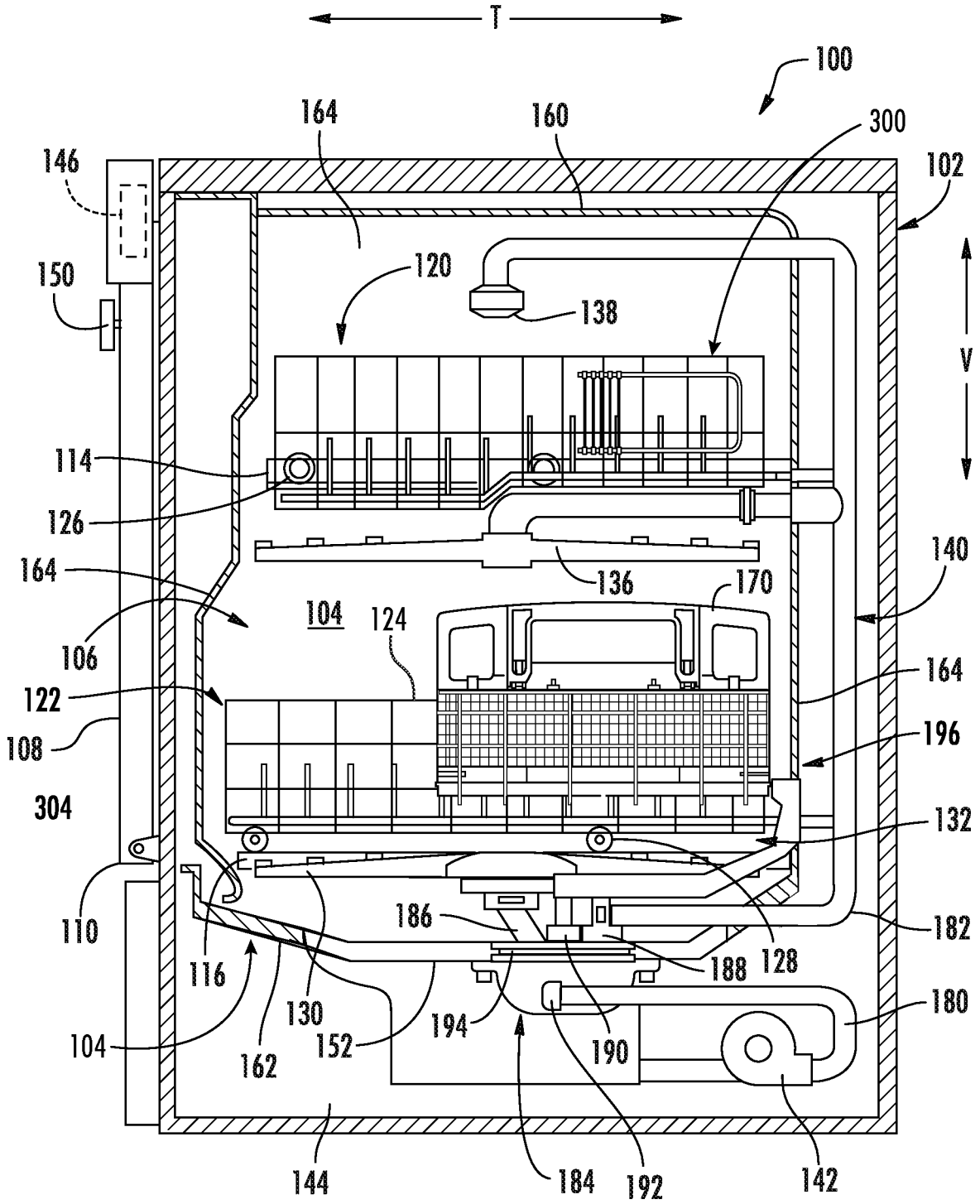
FIG. 2 provides sectional elevation view of the exemplary dishwashing appliance of FIG. 1.
Figure 3:
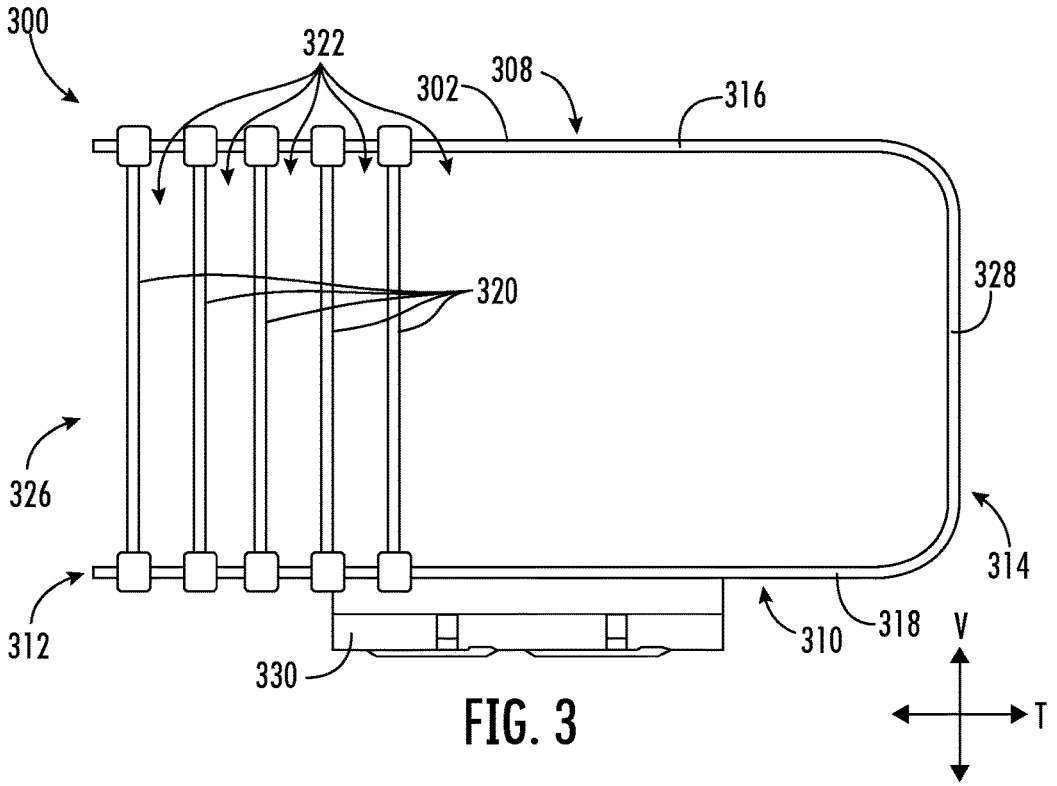
FIG. 3 provides a side elevation view of a removable rack assembly according to exemplary embodiments of the present disclosure.
Figure 4:
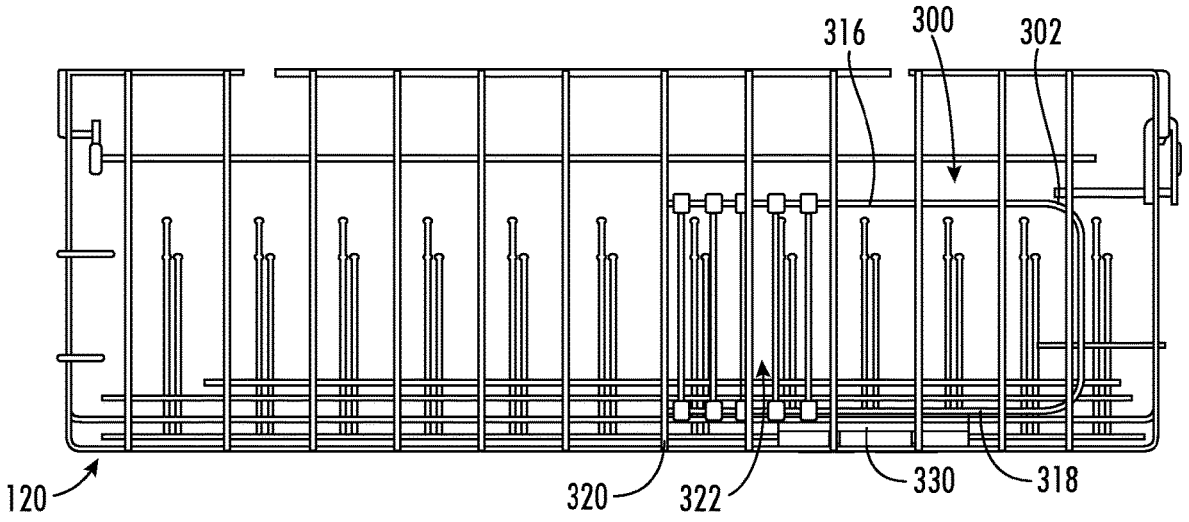
FIG. 4 provides a side elevation view of the exemplary rack assembly of FIG. 3 in a stored position within a rack assembly according to exemplary embodiments of the present disclosure.
Figure 5:
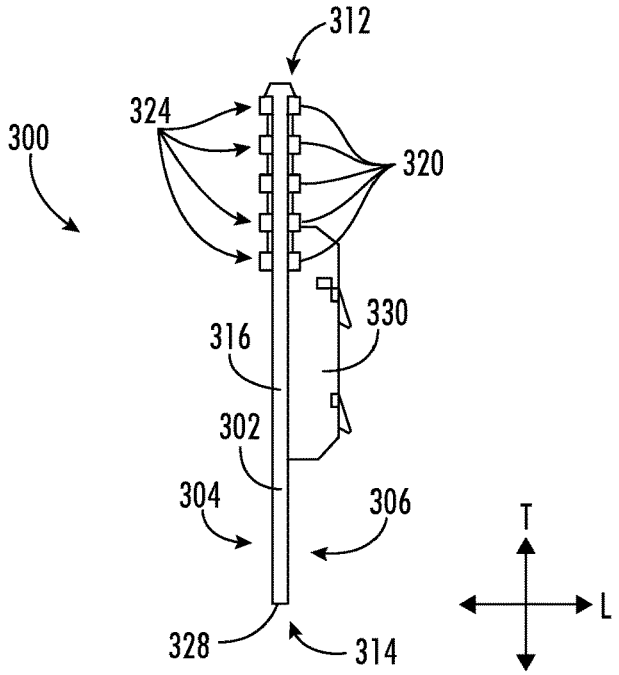
FIG. 5 provides a top plan view of the exemplary rack assembly of FIG. 3.
Figure 6:
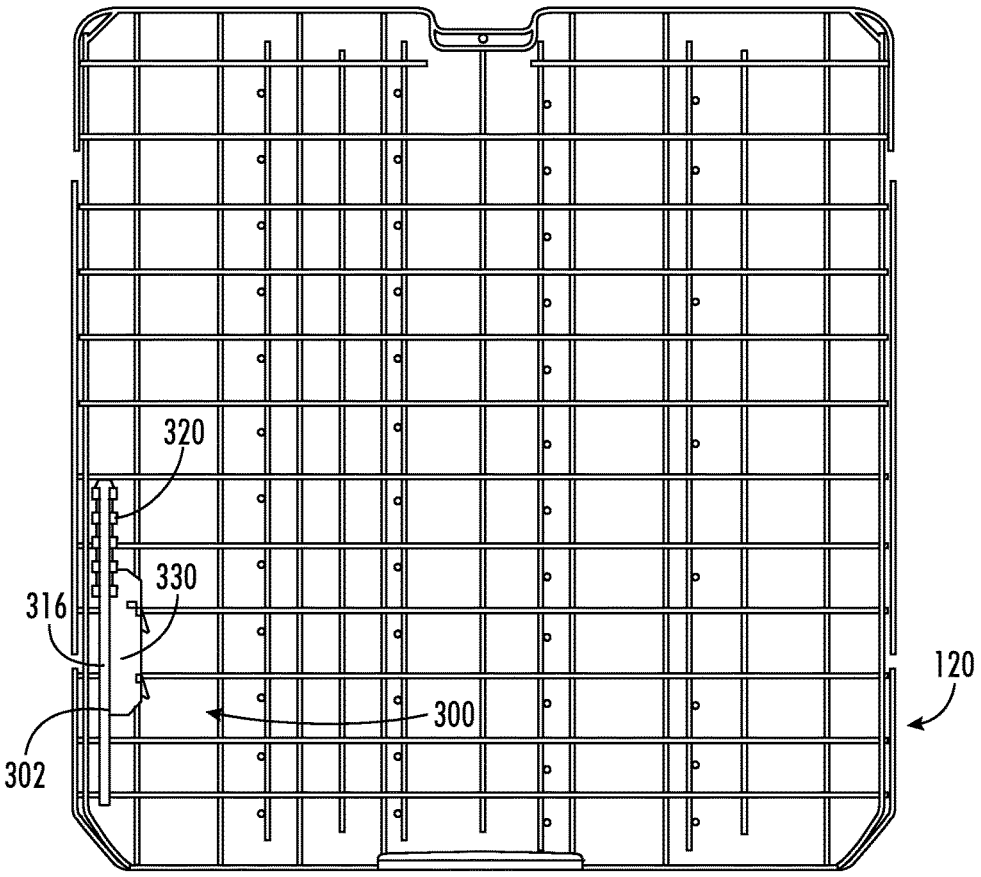
FIG. 6 provides a top plan view of the exemplary rack assembly of FIG. 3 in a stored position within a rack assembly according to exemplary embodiments of the present disclosure.

Turning now to the FIGURES, FIGS. 1 and 2 illustrate exemplary embodiments of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. Optionally, a latch 112 may be used to lock and unlock the door 108 for access to the chamber 106.

Generally, the tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. For instance, in several embodiments, the tub 104 is formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside the wash chamber 106, and a retracted position (shown in FIGS. 1 and 2) in which the rack 120, 122 is located inside the wash chamber 106. This may be facilitated by rollers 126 and 128, for example, mounted onto racks 120 and 122, respectively.

In some embodiments, a basket 170 is removably mounted to lower rack assembly 122. In additional or alternative exemplary embodiments, the basket 170 can be selectively or removably attached to other portions of dishwashing appliance 100 (e.g., upper rack assembly 120 or door 108). The basket 170 defines one or more storage chambers and is generally configured to receive of silverware, flatware, utensils, and the like, that are too small to be accommodated by the upper and lower rack assemblies 120, 122. The basket 170 may be constructed of any suitable material (e.g., metal or polymer) and define a plurality of fluid slots 178 for permitting wash fluid therethrough.

The dishwashing appliance 100 includes one or more spray assemblies housed within the wash chamber 106. For instance, the dishwashing appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of wash fluid flowing through the discharge ports. The resultant rotation of the lower spray-arm assembly 130 provides coverage of dishes and other dishwasher contents with a spray (e.g., a spray of wash fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within the wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally, as shown in FIG. 2, a portion of the bottom wall 162 of the tub 104 may be configured as a tub sump portion 152 that is configured to accommodate one or more components of the fluid recirculation assembly 140 (e.g., a filter assembly or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

As further shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Optionally, a third outlet 190 may direct the fluid received from the pump 142 to a variable jet assembly 196. Additionally, the diverter assembly 184 may also include a diverting valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Referring now generally to FIGS. 3 through 22, several views of a removable rack accessory 300 for a dishwasher appliance (e.g., dishwasher appliance 100) are provided. With specific reference to FIGS. 3, 5, 13, and 15, rack accessory 300 may define a vertical direction V, a lateral direction L, and a transverse direction T. The defined directions with reference to FIGS. 3, 5, 13, and 15 may or may not coincide with the defined directions with reference to FIGS. 1 and 2. For instance, rack accessory 300 may be rotatable with respect to rack assembly 120. The directions may coincide when rack accessory 300 is provided in an upright stored position (e.g., FIGS. 4, 6, 14, and 16) while being distinct when rack accessory 300 is folded down in a usable position (e.g., FIGS. 8, 10, 11, 18, and 20 through 22). Accordingly, hereinafter, the discussed directions refer to rack accessory 300 unrelated to dishwasher appliance 100 shown in FIGS. 1 and 2, except as otherwise indicated.

Removable rack accessory 300 may include a body 302. For instance, body 302 may define a thickness along the lateral direction L between a first face 304 and a second face 306. According to at least one embodiment, the thickness is between about 0.25 inches and about 0.5 inches. Body 302 may further define a height along the vertical direction V between an upper end 308 and a lower end 310. According to some embodiments, the height of body 302 may be between about 3 inches and about 5 inches. body 302 may still further define as a length along the transverse direction T between a first transverse end 312 and a second transverse end 314. The length of body 302 may be between about 7 inches and about 10 inches. Nonetheless, it should be understood that dimensions of body 302 may vary according to specific embodiments, and the disclosure is not limited to the examples given herein, except as otherwise indicated.

As shown, body 302 generally includes a rigid upper strut 316 (e.g., at the upper end 308) and a rigid lower strut 318 (e.g., at the lower end 310). The rigid lower strut 318 is spaced apart from the rigid upper strut 316 along the vertical direction V. Optionally, the rigid upper and lower struts 316, 318 may be parallel to each other and extend, for instance and at least in part, along the transverse direction T between the first transverse end 312 and the second transverse end 314. Between the rigid upper and lower struts 316, 318, a plurality of intermediate struts 320 are provided. In particular, the plurality of intermediate struts 320 generally extend along the vertical direction V from one or both of the rigid struts 316, 318. As will be described in greater detail below, the plurality of intermediate struts 320 may be movable, at least in part, along the transverse direction T.

Within or through the body 302, a plurality of apertures 322 are defined. Specifically, the rigid struts 316, 318 and intermediate struts 320 collectively define the plurality variable apertures 322, which each extend through the body 302 along the lateral direction L (e.g., to receive one or more container lids therein). The plurality of apertures 322 may be arranged (e.g., spaced apart) along the transverse direction T. For instance, a discrete aperture 322 may be disposed or positioned between transversely adjacent intermediate struts 320. A number or amount of apertures 322 may vary according to specific embodiments. For at least one example, five apertures 322 are formed (e.g., as shown in FIGS. 3 through 12). For at least one other example, six apertures 322 are formed (e.g., as shown in FIGS. 13 through 22). However, it should be understood that the disclosure is not limited to the examples given herein, and that any suitable number of apertures 322 may be formed.

Turning now especially to FIGS. 3 through 12, one or more (e.g., some or all) of the intermediate struts 320 may be provided as rigid members that are movable along and relative to the rigid upper and lower struts 316, 318. In some embodiments, one or more of the intermediate struts 320 extend continuously (e.g., as a single unbroken or unitary member) between the rigid upper strut 316 and the rigid lower strut 318. For instance, the rigid intermediate struts 320 may be provided as solid posts that extend parallel to the vertical direction V. As shown, the rigid intermediate struts 320 may be parallel to each other. Additionally or alternatively, the extension of the rigid intermediate struts 320 may be perpendicular to the rigid upper and lower struts 316, 318. In some such embodiments, the apertures 322 are defined as substantially rectangular passages (i.e., passages defining a rectangular profile). Optionally, the transverse width of each aperture 322 may be variable between adjacent intermediate struts 320 (e.g., to accommodate varying sizes or shapes of small objects, such as lids).

In certain embodiments, the intermediate struts 320 are slidably mounted within the body 302 (e.g., relative to one or more of the rigid upper and lower struts 316, 318). For instance, one or more of the intermediate struts 320 may be slidably supported on the rigid upper and lower struts 316, 318. Thus, a user may be permitted to push the intermediate struts 320 between the first transverse end 312 and the second transverse end 314 (e.g., to adjust the transverse width of one or more of the apertures 322). In some such embodiments, one or both of the rigid upper and lower struts 316, 318 acts as a support rail for a sliding tip of an intermediate strut 320. For instance, one or more of the intermediate struts 320 may include a sliding tip that defines a U-shaped tip 324 that receives either the rigid upper or lower strut 316 or 318 therein. Optionally, the prongs of the U-shaped tip 324 may extend laterally over the corresponding rigid upper or lower strut 316 or 318 (e.g., without having the prongs touch each other), such as to further contain the corresponding rigid upper or lower strut 316 or 318 (e.g., along the vertical direction V). Additionally or alternatively, rigid upper or lower strut 316 or 318 includes a laterally flared tip 338. Specifically, a laterally flared tip 338 extending laterally beyond (e.g., at a greater width than) the channel defined by the U-shaped tip 324 may be defined at the first transverse end 312. In turn, the laterally flared tip 338 may transversely block the U-shaped tip 324 of the one or more intermediate struts 320, and thus contain the intermediate struts 320 (e.g., relative to the transverse direction T) on the rigid upper or lower strut 316 or 318.

In some embodiments, both the rigid upper strut 316 and rigid lower strut 318 extend (e.g., continuously) along the transverse direction T between the first transverse end 312 and the second transverse end 314 (e.g., in parallel to each other). A vertical gap 326 may be defined between the rigid upper and lower struts 316, 318 at the first transverse end 312 (e.g., irrespective of the intermediate struts 320). Thus, the rigid upper and lower struts 316, 318 may define free ends at the first transverse end 312. Notably, the free ends of the rigid upper and lower struts 316, 318 may be permitted to deflect relative to each other (e.g., vertically), such as to permit a user to add or remove an intermediate strut 320 (e.g., by further deflecting or forcing the prongs of the U-shaped tip laterally outwards to permit the selective vertical movement of the rigid upper strut 316 or corresponding intermediate strut 320).

Opposite the vertical gap 326 (e.g., along the transverse direction T) at the second transverse end 314, a rigid support arm 328 may be provided. For instance, the rigid support arm 328 may extend vertically between the rigid upper and lower struts 316, 318. As shown, the rigid support arm 328 may be fixedly attached to the rigid upper and lower struts 316, 318. In other words, the rigid support arm 328 may extend in fixed attachment to the rigid upper and lower struts 316, 318 (e.g., to maintain the vertical height of the body 302 at the second transverse end 314). Optionally, the rigid support arm 328 may be integral (e.g., formed as a single unitary member) with the rigid upper and lower struts 316, 318. Even if the free ends of the rigid upper and lower struts 316, 318 are deflected (e.g., vertically), the rigid support arm 328 may maintain a connection between the rigid upper and lower struts 316, 318.

As shown, the body 302 is generally movable between a stored position and a usable position. In the stored position, the body 302 may be oriented upward (e.g., so as to minimize the rack space or horizontal footprint occupied by the body 302). By contrast, in the usable position, the body 302 may be oriented at an angle (e.g., non-parallel to the vertical direction or the lateral direction defined by dishwasher 100—FIG. 1). For instance, the upper end 308 may be laterally offset from or otherwise unaligned with the lower end 310 along the vertical direction defined by the dishwasher 100. Furthermore, relative to the vertical direction defined by the dishwasher 100, the apertures 322 may be vertically open in the usable position such that one or more small objects (e.g., lids) may be vertically received therein for washing.

In optional embodiments, rack accessory 300 includes a mounting portion 330. In detail, mounting portion 330 may extend or protrude from body 302 (e.g., the rigid lower strut 318). Mounting portion 330 may extend along the vertical direction V. According to at least some embodiments, mounting portion 330 extends downward along the vertical direction V (e.g., with reference to a stored position of rack accessory 300 within dishwasher appliance 100). Mounting portion 330 may include at least one slide tab 332. The at least one slide tab 332 may extend along the transverse direction T (e.g., toward second transverse end 314). Slide tab 332 may at least partially form a groove 334 (described below) for attaching rack accessory 300 to rack assembly 120. For instance, slide tab 332 may be spaced apart from mounting portion 330 along the transverse direction T or the lateral direction L. According to one embodiment, two slide tabs 332 are provided.

Figure 7:
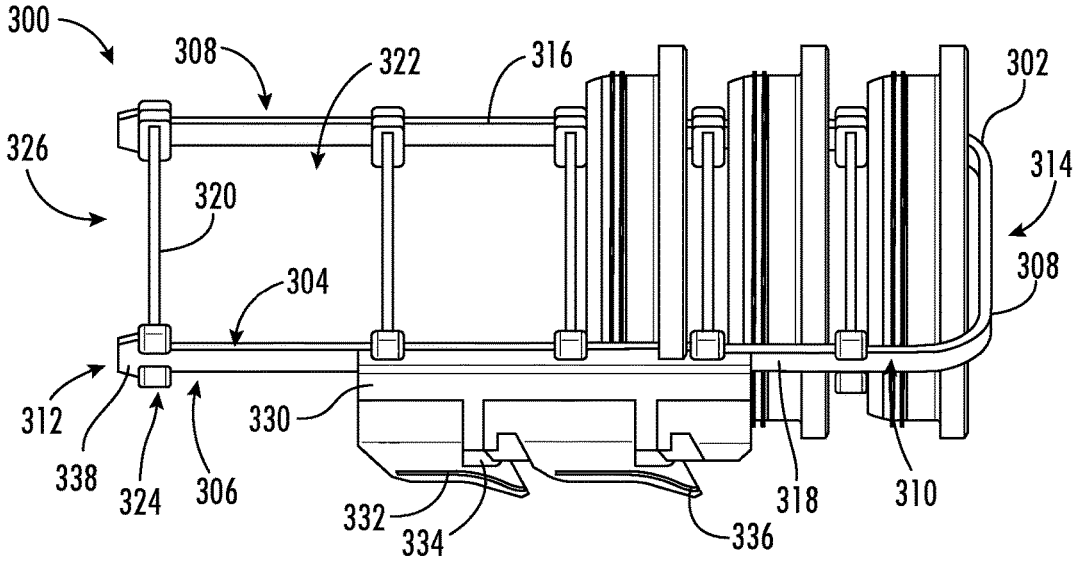
FIG. 7 provides a side perspective view of the exemplary rack assembly of FIG. 3.
Figure 8:
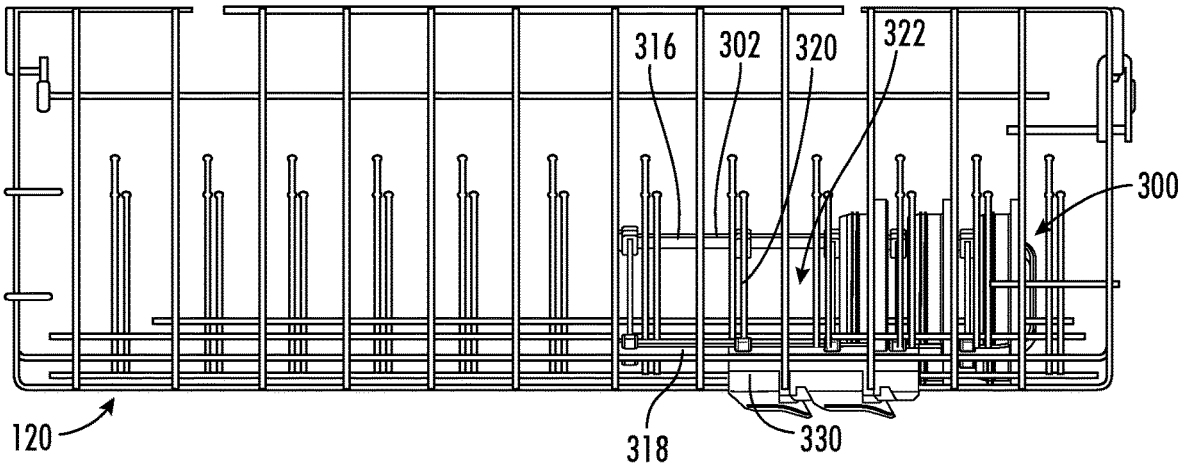
FIG. 8 provides a side elevation view of the exemplary rack assembly of FIG. 3 in a usable position within a rack assembly according to exemplary embodiments of the present disclosure.
Figure 9:
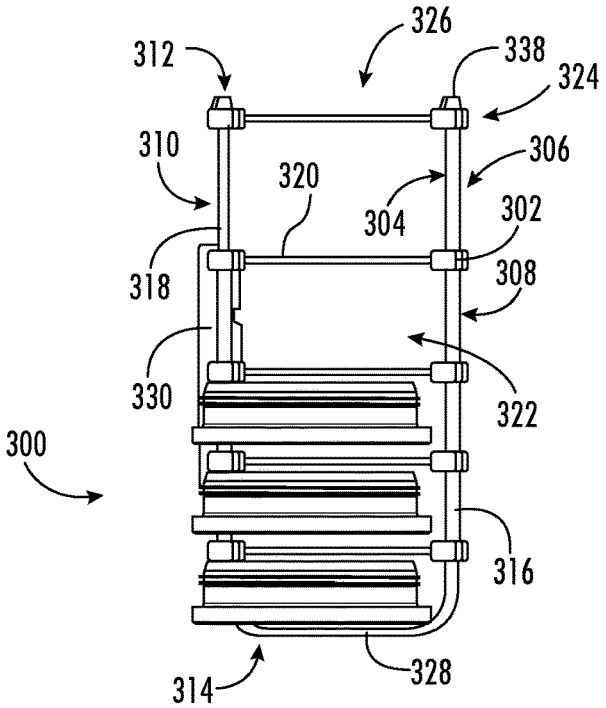
FIG. 9 provides a top perspective view of the exemplary rack assembly of FIG. 3.
Figure 10:
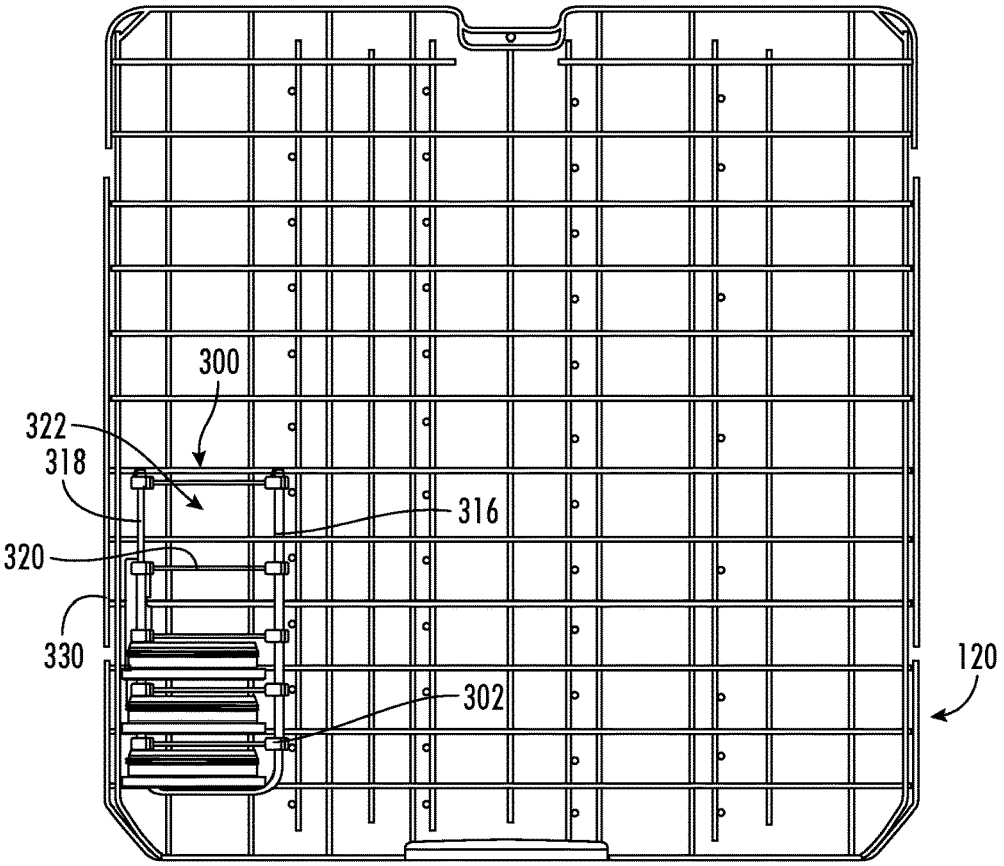
FIG. 10 provides a top plan view of the exemplary rack assembly of FIG. 3 in a usable position within a rack assembly according to exemplary embodiments of the present disclosure.
Figure 11:
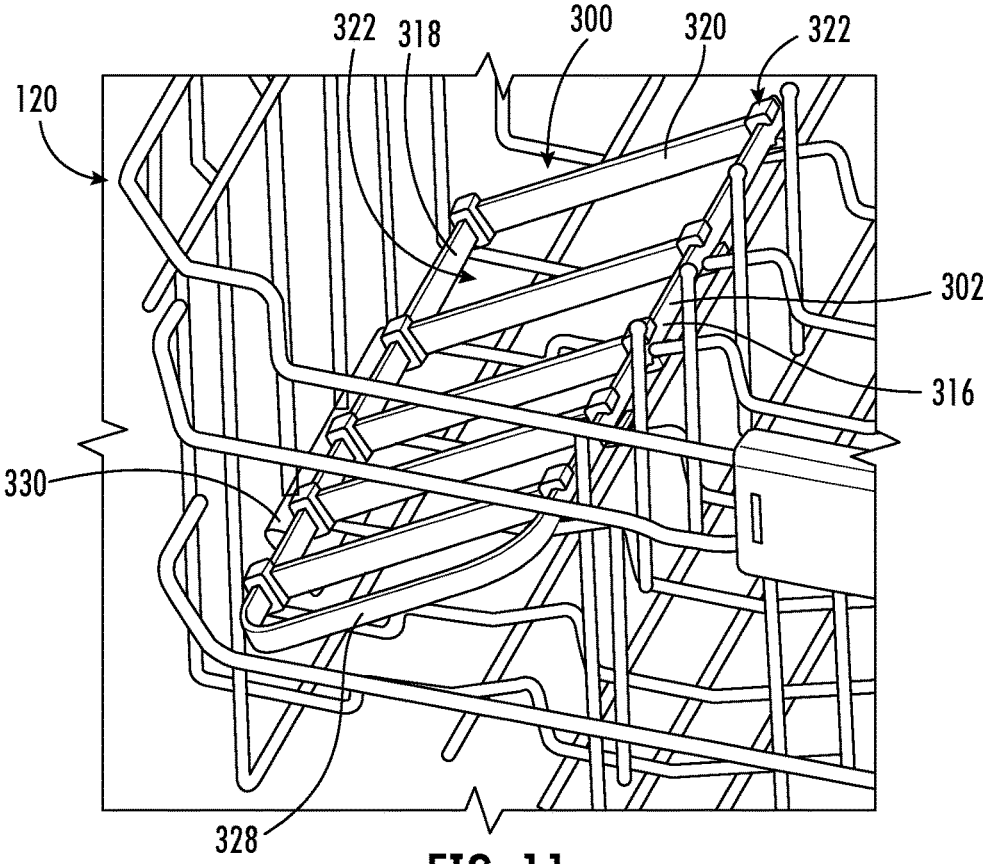
FIG. 11 provides a perspective view of the exemplary rack assembly of FIG. 3 in a usable position within a rack assembly according to exemplary embodiments of the present disclosure.
Figure 12:
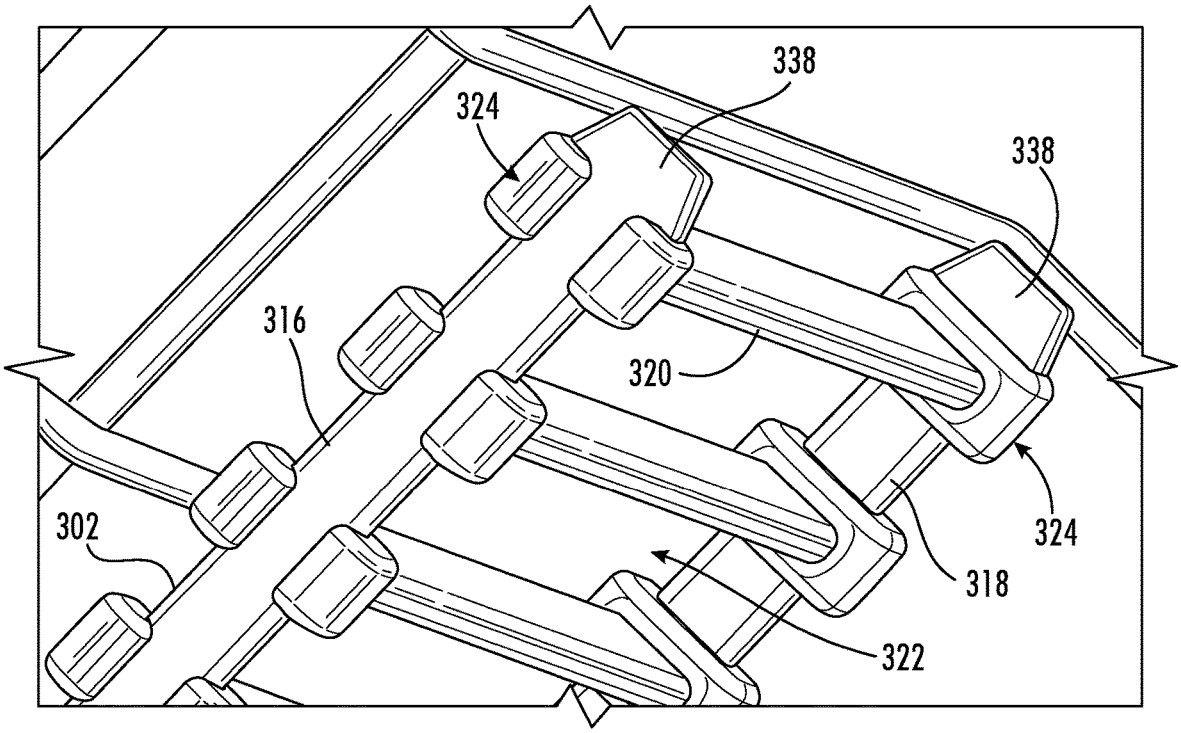
FIG. 12 provides a magnified perspective view of a portion of the exemplary rack assembly of FIG. 3.
Figure 13:
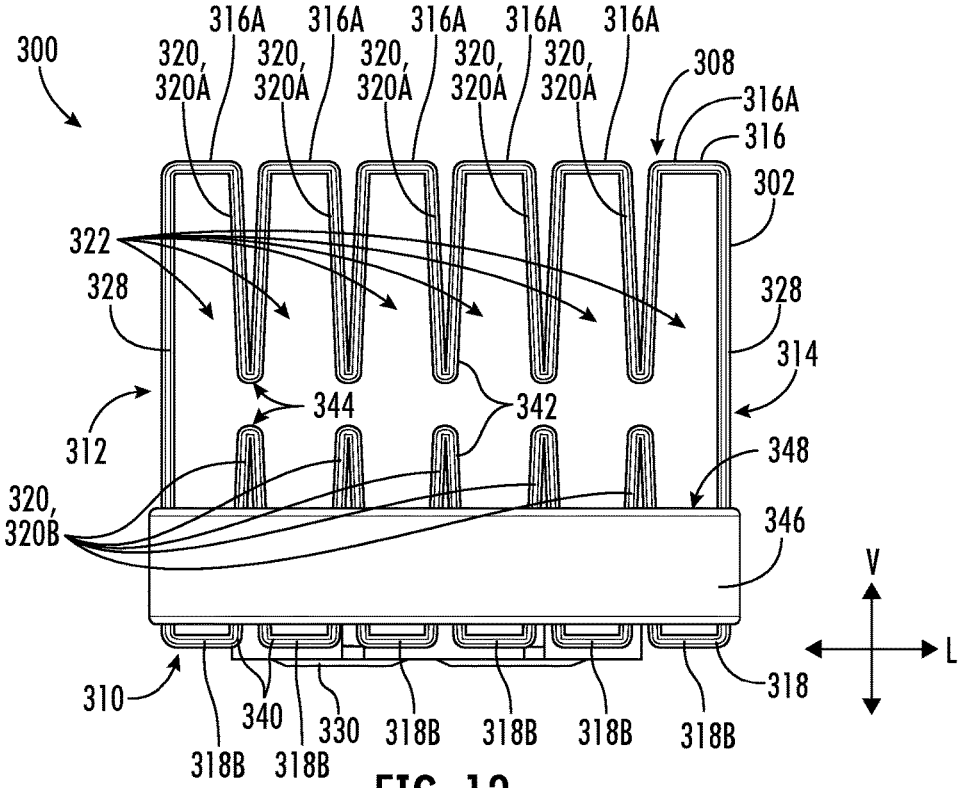
FIG. 13 provides a side elevation view of a removable rack assembly according to exemplary embodiments of the present disclosure.
Figure 14:
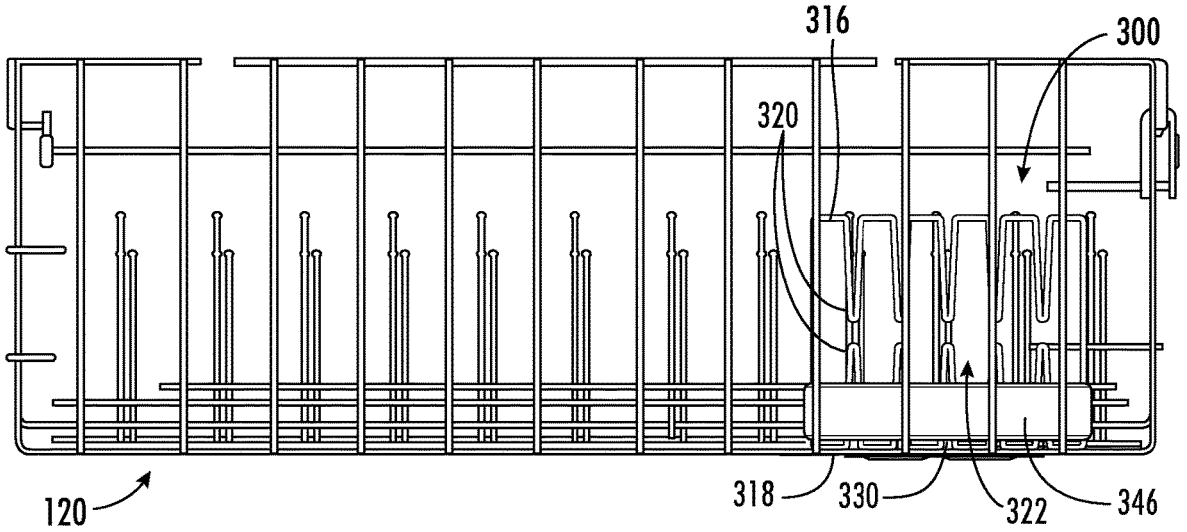
FIG. 14 provides a side elevation view of the exemplary rack assembly of FIG. 13 in a stored position within a rack assembly according to exemplary embodiments of the present disclosure.
Figure 15:
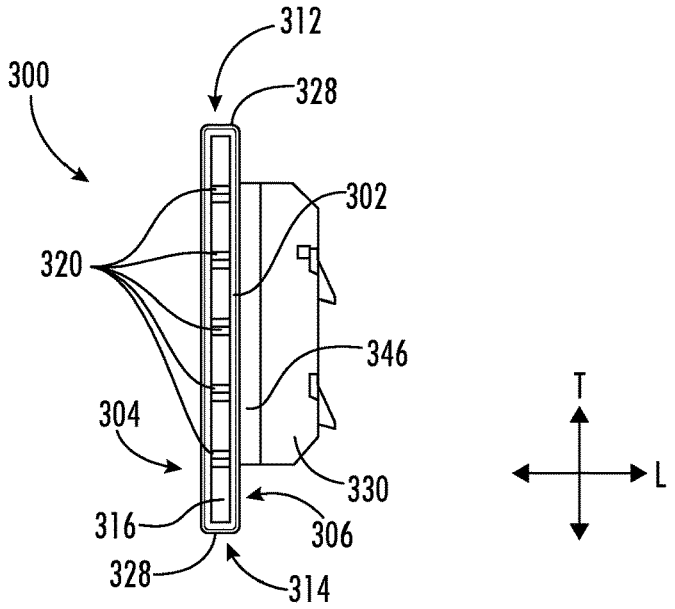
FIG. 15 provides a top plan view of the exemplary rack assembly of FIG. 13.
Figure 16:
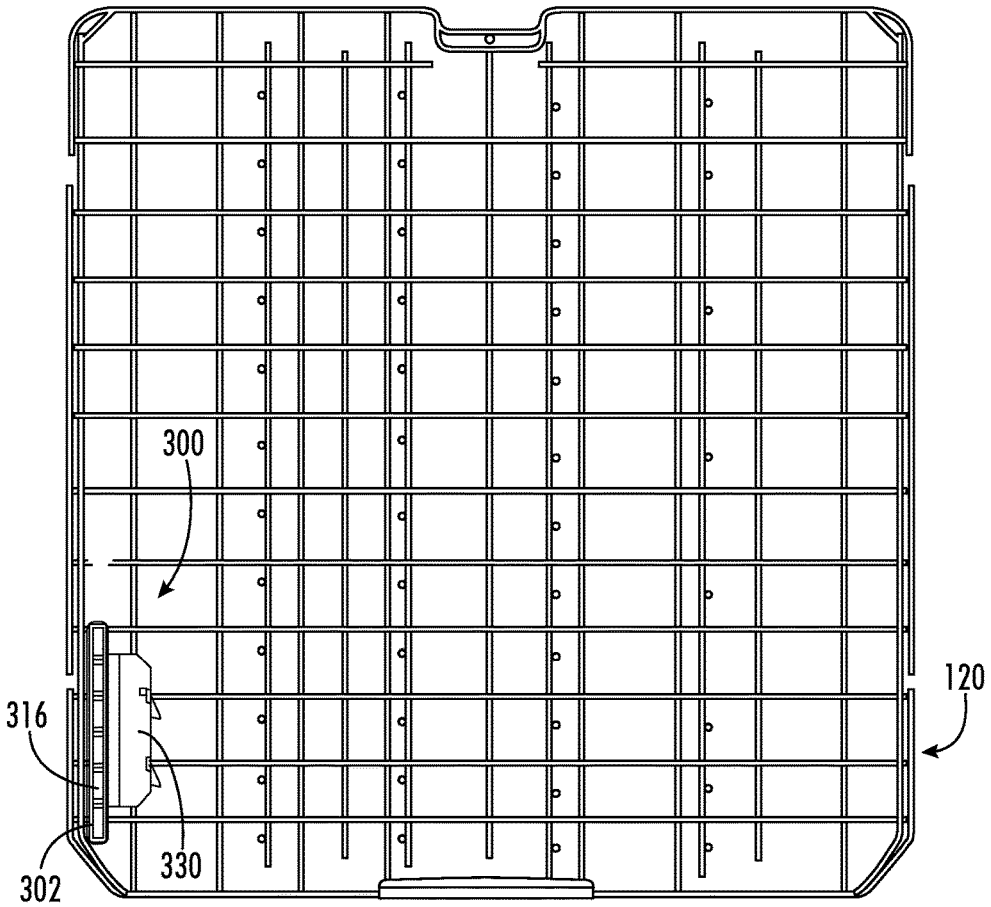
FIG. 16 provides a top plan view of the exemplary rack assembly of FIG. 13 in a stored position within a rack assembly according to exemplary embodiments of the present disclosure.
Figure 17:
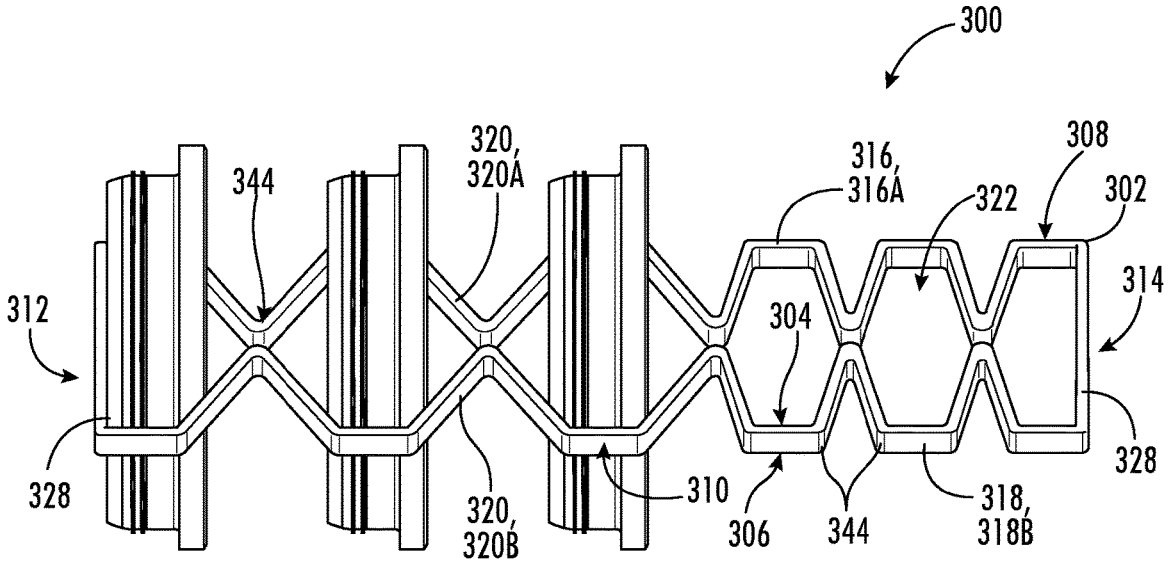
FIG. 17 provides a side perspective view of the exemplary rack assembly of FIG. 13.
Figure 18:
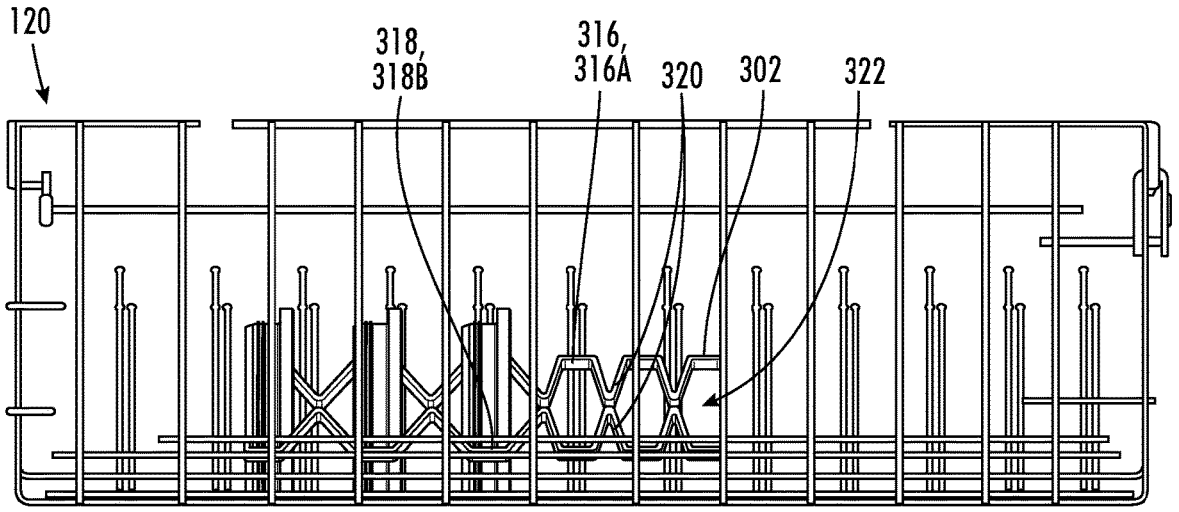
FIG. 18 provides a side elevation view of the exemplary rack assembly of FIG. 3 in a usable position within a rack assembly according to exemplary embodiments of the present disclosure.
Figure 19:
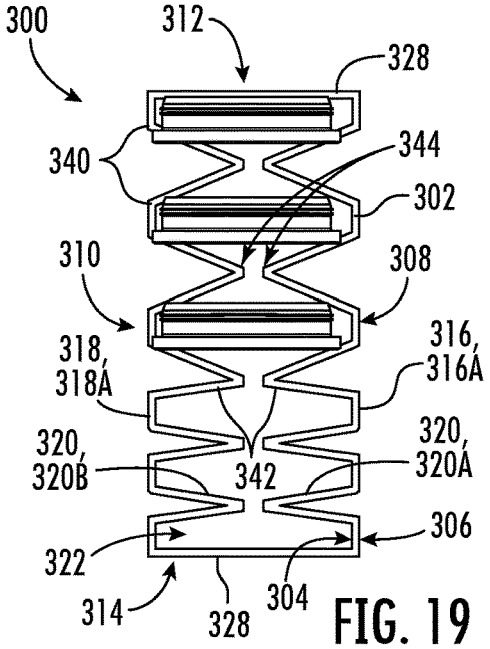
FIG. 19 provides a top perspective view of the exemplary rack assembly of FIG. 3.
Figure 20:
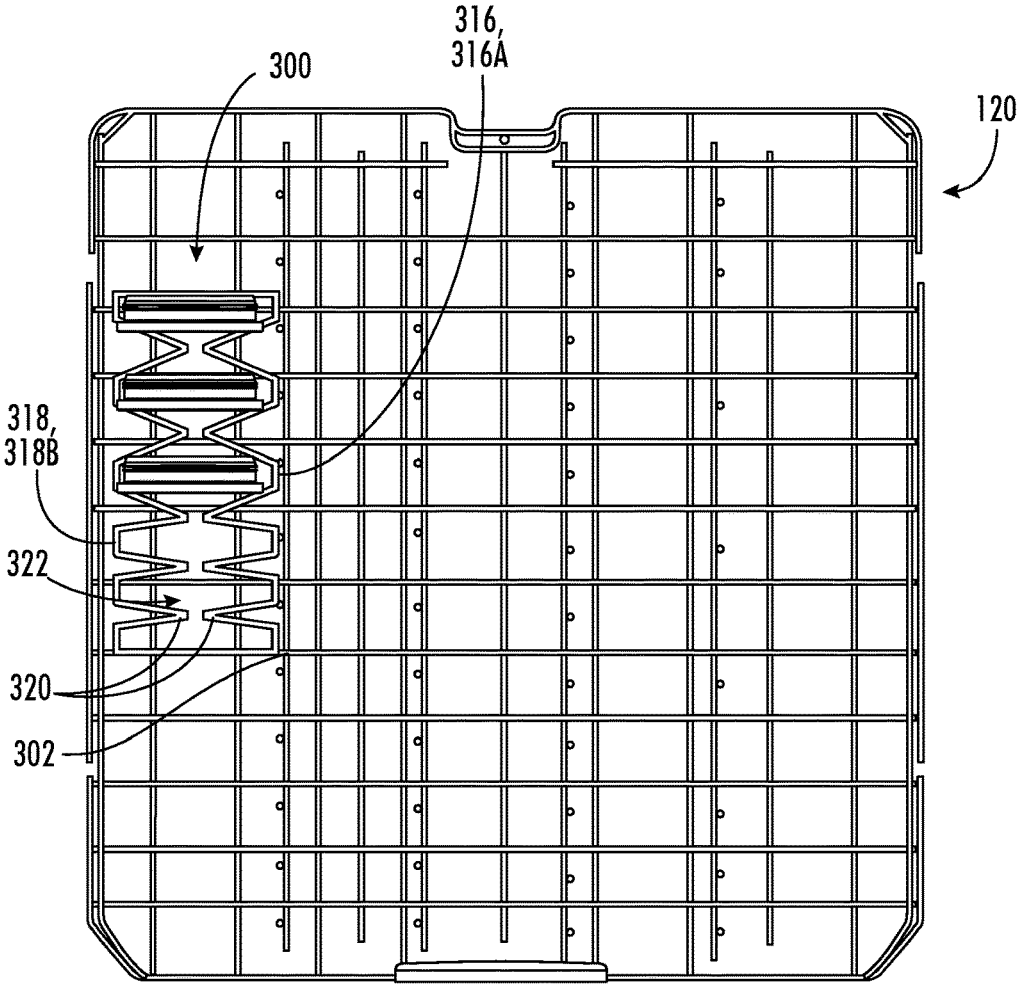
FIG. 20 provides a top plan view of the exemplary rack assembly of FIG. 3 in a usable position within a rack assembly according to exemplary embodiments of the present disclosure.
Figure 21:
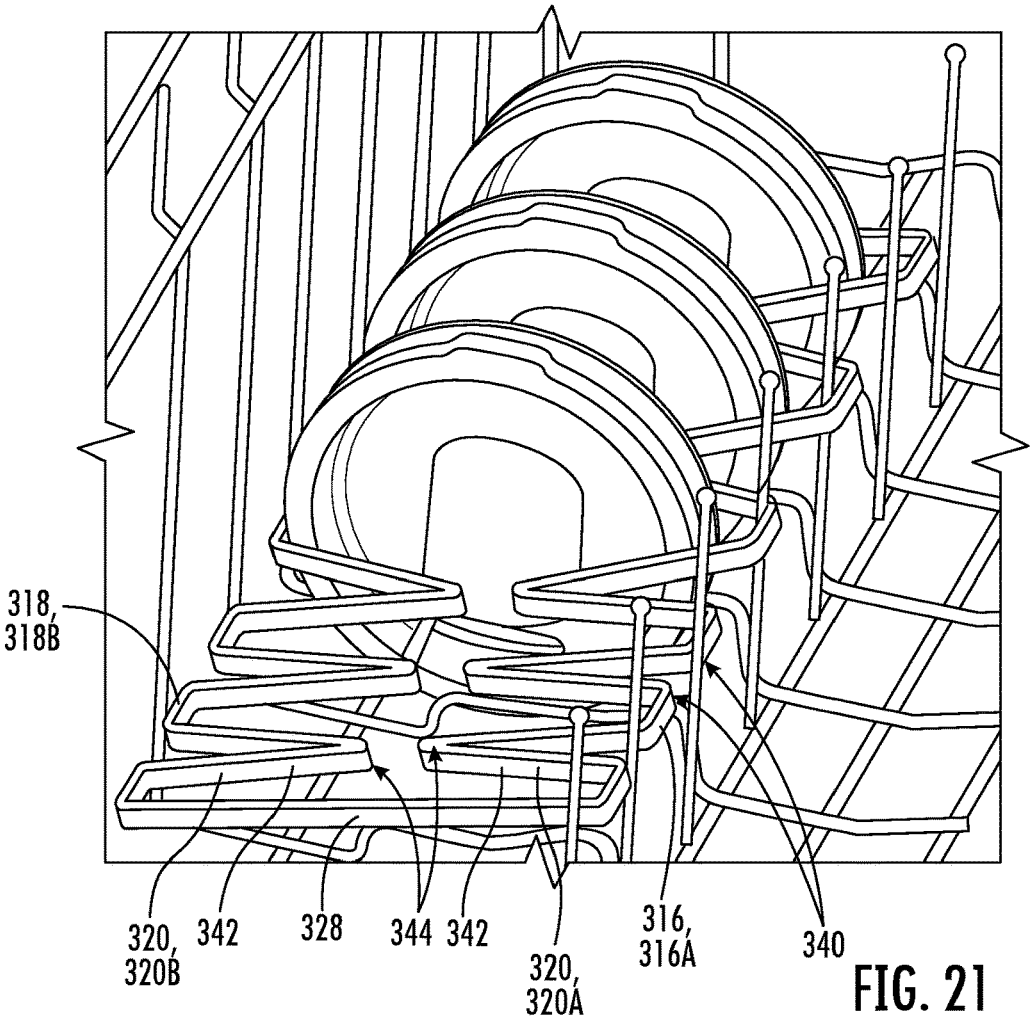
FIG. 21 provides a perspective view of the exemplary rack assembly of FIG. 13 in a usable position within a rack assembly according to exemplary embodiments of the present disclosure.
Figure 22:
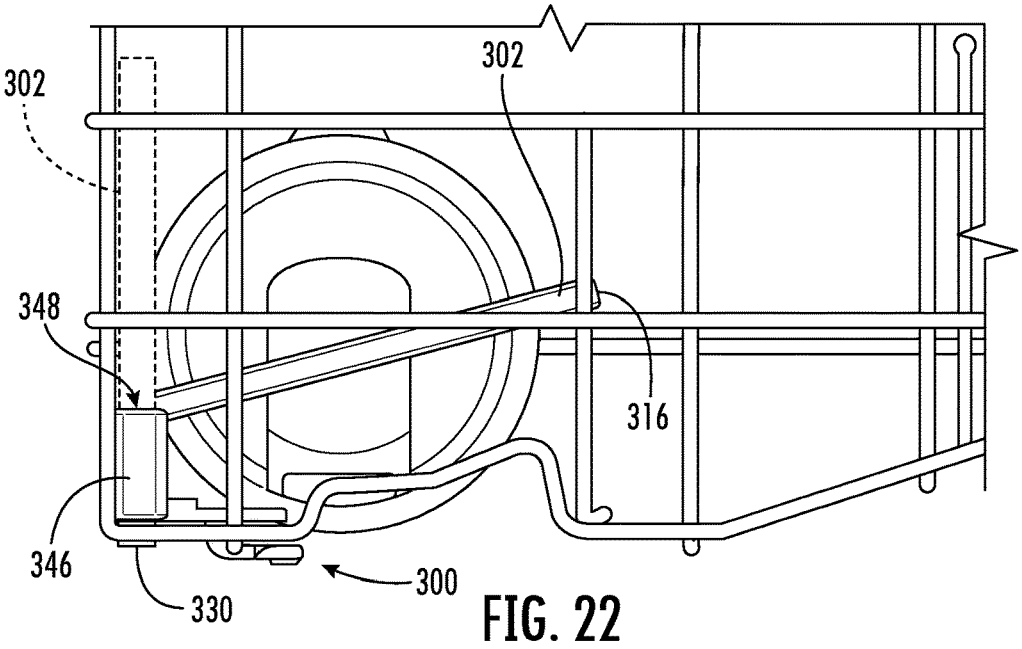
FIG. 22 provides a front elevation view of the exemplary rack assembly of FIG. 13 to illustrate the difference between a stored position and a usable position.

Mounting portion 330 may define a plurality of grooves 334 therein. With reference especially to FIG. 7, a single groove 334 will be described in relation to a single slide tab 332. It should be understood that this description will apply to each additional slide tab 332 or groove 334 provided. Groove 334 may be formed between slide tab 332 and mounting portion 330. For instance, groove 334 may extend from a vertically distal point of mounting portion 330 first along the vertical direction V, subsequently along the transverse direction T, and finally along the lateral direction L. Thus, a serpentine path may be formed by groove 334. Accordingly, groove 334 may form an opening along the vertical direction V and lateral direction L. Groove 334 may thus freely allow rack accessory 300 to attach to rack assembly 120 and rotate while attached to the rack (e.g., in a rotatable fashion). Additionally or alternatively, slide tab 332 may include a protrusion 336 extending along the lateral direction L (e.g., toward mounting portion 330). Protrusion 336 may partially form groove 334 (e.g., the vertical and transverse portions thereof).

In detail, rack accessory 300 may be selectively attached to a rack (e.g., rack assembly 120) within dishwasher appliance 100. Rack assembly 120 may include one or more tines therein, subsequently forming a lattice structure of the rack 120. Moreover, groove 334 may be defined as a complementary negative of at least one tine of the rack 120. In turn, groove 334 may be maneuvered into place such that a tine is accepted within groove 334. A user may subsequently feed rack accessory 300 along the tine, following groove 334. In at least one example, the user may first slide mounting portion 330 downward (e.g., along the vertical direction V) into or onto a tine, and then slide mounting portion toward a front (or rear) of the rack 120 (e.g., along the transverse direction T) such that the tine is positioned past protrusion 336 of slide tab 332. Rack accessory 300 may then be rotatable about one or more tines within the one or more grooves 334 (e.g., along the vertical direction V). Advantageously, when not in use, rack accessory 300 may be rotated (e.g., to the stored position so as to be parallel with a side wall of rack assembly 120).

Turning now especially to FIGS. 13 through 22, one or more (e.g., some or all) of the intermediate struts 320 may be provided as bendable members that are pivotable on and relative to the rigid upper and lower struts 316, 318. In some embodiments, one or more of the intermediate struts 320 includes a living hinge 340 that joins the intermediate strut 320 to the rigid upper or lower strut 316 or 318. In other words, the living hinge 340 forms a connection point between the intermediate strut 320 and either the rigid upper strut 316 or the rigid lower strut 318.

In some embodiments, separate intermediate struts 320 are provided for the rigid upper and lower struts 316, 318.

As an example, a plurality of top intermediate struts 320A may be joined to the rigid upper strut 316. In some such embodiments, the rigid upper strut 316 comprises a plurality of segments 316A that are joined together by the plurality of top intermediate struts 320A. Optionally, each of the top intermediate struts 320A may be a bent member spaced apart from the rigid lower strut 318. For instance, each top intermediate strut 320A may include a V-shaped member 342 having a hinged apex 344 (e.g., living or bendable hinge). As shown, the two arms of the V-shaped member 342 may connect to separate segments 316A of the rigid upper strut 316 at separate corresponding living hinges 340. Thus, the V-shaped member 342 defines at least three discrete pivot points for movement of the corresponding top intermediate strut 320A.

As an additional or alternative example, a plurality of bottom intermediate struts 320B may be joined to the rigid lower strut 318. In some such embodiments, the rigid lower strut 318 comprises a plurality of segments 318B that are joined together by the plurality of bottom intermediate struts 320B. Optionally, the number and transverse location of bottom intermediate struts 320B may be matched to (e.g., the same as) the number and transverse location of top intermediate struts 320A. Additionally or alternatively, each of the bottom intermediate struts 320B may be a bent member spaced apart from the rigid upper strut 316. Each bottom intermediate strut 320B may include a V-shaped member 342 having a hinged apex 344 (e.g., living or bendable hinge). As shown, the two arms of the V-shaped member 342 may connect to separate segments 318B of the rigid lower strut 318 at separate corresponding living hinges 340. Thus, the V-shaped member 342 defines at least three discrete pivot points for movement of the corresponding bottom intermediate strut 320B.

As shown, one or more rigid support arms 328 may be provided. For instance, as shown, a pair of rigid support arms 328 may extend vertically between the rigid upper and lower struts 316, 318 at opposite lateral ends. Thus, one rigid support arm 328 may be fixedly attached to the rigid upper and lower struts 316, 318 at the first transverse end 312 while another rigid support arm 328 may be fixedly attached to the rigid upper and lower struts 316, 318 at the second transverse end 314. In other words, the rigid support arm 328 may extend in fixed attachment to the rigid upper and lower struts 316, 318 (e.g., to maintain the vertical height of body 302 at both transverse ends 312, 314). Optionally, the rigid support arms 328 may be integral (e.g., formed as a single unitary member) with the rigid upper and lower struts 316, 318 (e.g., separate segments thereof).

In some embodiments, the apertures 322 are defined as a plurality of mutually connected passages. For instance, although the top and bottom intermediate struts 320B may delineate discrete apertures 322, a gap may be formed (e.g., between aligned vertical apexes 344) between adjacent apertures 322. Moreover, the body 302 may transversely expand (e.g., similar to an accordion or folded unit) to advantageously and selectively increase the transverse width of the apertures 322.

As shown, the body 302 is generally movable between a stored position and a usable position. In the stored position, the body 302 may be compacted or oriented upward (e.g., so as to minimize the rack space or horizontal footprint occupied by the body 302). By contrast, in the usable position, the body 302 may be laterally offset from or otherwise unaligned with the lower end 310 along the vertical direction defined by the dishwasher 100. For instance, the upper end 308 may be laterally offset from or otherwise unaligned with the lower end 310 along the vertical direction defined by the dishwasher 100. Separate tines of the rack 120 may be configured to hold the body 302 in the usable position (e.g., by friction, as shown). Furthermore, relative to the vertical direction defined by the dishwasher 100, the apertures 322 may be vertically open in the usable position such that one or more small objects (e.g., lids) may be vertically received therein for washing.

In optional embodiments, a holster 346 may be provided to hold the body 302 in the (e.g., compacted) stored position. Such a holster 346 may be attached to the rack 120 and selectively separable from the body 302 itself. For instance, holster 346 may include a mounting portion 330 securing itself to one or more tines of the rack 120, apart from body 302. Additionally or alternatively, holster 346 may define a vertical pocket 348 within which the body 302 may be at least partially received (i.e., in the stored position).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A removable rack accessory for a dishwashing appliance, the removable rack accessory defining a vertical direction, a lateral direction, and a transverse direction, the removable rack accessory comprising:

a rigid upper strut;

a rigid lower strut spaced apart from the rigid upper strut along the vertical direction; and a plurality of intermediate struts extending between the rigid upper and lower struts, the intermediate struts being pivotable relative to the rigid upper and lower struts, wherein the plurality of intermediate struts and the rigid upper and lower struts collectively define a plurality of variable apertures extending through the removable rack accessory along the lateral direction to receive one or more container lids therein, wherein the plurality of intermediate struts comprises a plurality of top intermediate struts, wherein the rigid upper strut comprises a plurality of segments joined together by the plurality of top intermediate struts such that a variable transverse gap is defined between transversely adjacent segments of the plurality of segments of the rigid upper strut to permit relative transverse movement between the transversely adjacent segments of the plurality of segments of the rigid upper strut, wherein each top intermediate strut comprises a V-shaped member having a hinged vertical apex, wherein the plurality of intermediate struts comprises a plurality of bottom intermediate struts, wherein the rigid lower strut comprises a plurality of segments joined together by the plurality of bottom intermediate struts such that a variable transverse gap is defined between transversely adjacent segments of the plurality of segments of the rigid lower strut to permit relative transverse movement between the transversely adjacent segments of the plurality of segments of the rigid lower strut, and wherein each bottom intermediate strut comprises a V-shaped member having a hinged vertical apex, the hinged vertical apex of each bottom intermediate strut being vertically aligned between a hinged vertical apex of top intermediate strut such that a gap is formed between the vertically aligned hinged vertical apexes.

2. The removable rack accessory of claim 1, wherein the V-shaped member of each top intermediate strut of the plurality of top intermediate struts defines three discrete pivot points for movement of each top intermediate strut.

3. The removable rack accessory of claim 2, wherein the V-shaped member of each bottom intermediate strut of the plurality of bottom intermediate struts defines three discrete pivot points for movement of each bottom intermediate strut.

4. The removable rack accessory of claim 1, wherein a number of bottom intermediate struts of the plurality of bottom intermediate struts is matched to a number of top intermediate struts of the plurality of top intermediate struts.

5. The removable rack accessory of claim 4, wherein a transverse location of each bottom intermediate strut of the plurality of bottom intermediate struts is matched to a location of a corresponding top intermediate strut of the plurality of top intermediate struts.

6. The removable rack accessory of claim 1, wherein each top intermediate strut of the plurality of top intermediate struts is a bent member spaced apart from the rigid lower strut.

7. The removable rack accessory of claim 1, wherein each bottom intermediate strut of the plurality of bottom intermediate struts is a bent member spaced apart from the rigid upper strut.

8. The removable rack accessory of claim 1, the removable rack assembly of claim 1, wherein the rigid upper and lower struts extend along the transverse direction between a first transverse end and a second transverse end, wherein a vertical gap is defined between the rigid upper and lower struts at the first transverse end, and wherein a first rigid support arm extends vertically between the rigid upper and lower struts at the second transverse end in fixed attachment to the rigid upper and lower struts.

9. The removable rack accessory of claim 8, wherein a second rigid support arm extends vertically between the rigid upper and lower struts at the first transverse end in fixed attachment to the rigid upper and lower struts.

10. The removable rack accessory of claim 8, wherein the first rigid support arm is integral with the rigid upper and lower struts.

11. The removable rack accessory of claim 8, wherein the rigid upper strut, the rigid lower strut, and the plurality of intermediate struts define a body, and wherein the removable rack accessory further comprises a holster defining a vertical pocket within which the body is selectively received.

* * * * *